US006058849A

United States Patent [19]

Ostholt et al.

[11] Patent Number: 6,058,849

[45] Date of Patent: May 9, 2000

[54] TRAVELING MECHANISM IN A LIFTING ARRANGEMENT WHICH IS MOVEABLE ON RAILS

[75] Inventors: Rüdiger Ostholt; Klaus Becker, both of Wetter; Klaus-Dieter Gabriel, Hagen, all of Germany

[73] Assignee: Mannesmann Aktiengesellschaft, Düsseldorf, Germany

[21] Appl. No.: 08/963,352

[22] Filed: Nov. 3, 1997

[30] Foreign Application Priority Data

Nov. 29, 1996 [DE] Germany ..... 196 51 007

[51] Int. Cl.[7] ..... B61B 3/00; E01B 25/22

[52] U.S. Cl. ..... 104/93; 104/89; 104/139; 105/141; 105/146; 105/150; 105/154

[58] Field of Search ..... 104/89, 93, 106, 104/138.1, 139; 105/141, 146, 147, 148, 150, 154

[56] References Cited

U.S. PATENT DOCUMENTS

| | | | |
|---|---|---|---|
| 2,337,200 | 12/1943 | Huntley | 212/11 |
| 2,778,512 | 1/1957 | Strona | 214/75 |
| 4,144,817 | 3/1979 | Morita | 104/106 |
| 4,172,423 | 10/1979 | Monne | 104/94 |
| 4,841,871 | 6/1989 | Leibowitz | 104/139 |
| 5,085,150 | 2/1992 | Moore et al. | 104/93 |

*Primary Examiner*—S. Joseph Morano
*Assistant Examiner*—Robet J. McCarry, Jr.
*Attorney, Agent, or Firm*—Cohen, Pontani, Lieberman & Pavane

[57] ABSTRACT

A traveling mechanism for a lifting device, especially for a lifting device having a laterally cantilevering boom, is movable on rails with at least two running wheels. A connection element for attaching a load to said traveling mechanism is supported in the rail by the running wheels which are arranged on both sides of the connection element. The connection element has, at the region projecting down out of the rail, at least one running roller which is freely rotatable about a horizontal axis and rolls on a horizontal outer running surface of the rail. To effectively divert horizontal forces and uniformly distribute the vertical forces to the running wheels, running wheel axles are rigidly connected with a running wheel carrier, and the running wheel carrier and connection element are swivelably connected by a universal type joint. In addition, at least one support roller is rotatably mounted at the connection element in the interior of the rail. The support roller freely rotates about a vertical axis and rolls along at least one of the side surfaces to transmit horizontal forces to the rail.

10 Claims, 6 Drawing Sheets

TRAVELING MECHANISM IN A LIFTING ARRANGEMENT WHICH IS MOVEABLE ON RAILS

BACKGROUND OF THE INVENTION

1. Field of the Invention

The present invention relates to a traveling mechanism for a lifting device which is movable on rails, particularly for a lifting device having a laterally cantilevering boom.

2. Description of the Related Art

A traveling mechanism of a lifting device which is movable on rails is known from the brochure "Kranbaukasten KBK [KBK Crane Building Blocks]" by Mannesmann Demag Fördertechnik AG. This prior art traveling mechanism has running wheels which run parallel to one another in pairs one behind the other in the traveling direction. The running wheels roll within an interior of a downward-opening hollow-section rail of an overhead track on substantially horizontal inner running surfaces of the rail. The running surfaces extend in the longitudinal direction of the rail and are sloped relative to one another. To attach a load, a connection element is connected with axles of the running wheels. The connection element projects downward out of the rail for attachment to the load to be carried.

These traveling mechanisms with the associated adapted rails are also suitable for the operation of pillar and wall-mounted swiveling jib cranes, monorail systems and suspension cranes.

The rails are optionally combined with one another and are assembled by automatically centering plug-in and screw connections. The horizontal forces occurring as a result of buffer stroke or approach procedures and braking processes are substantially absorbed by a pendulum type suspension of the interconnected rails.

A disadvantage in these known traveling mechanisms and rails consists in that, although they are very well suited for use with pendulum type suspensions, these traveling mechanisms are severely worn or even destroyed when used with a rigidly suspended rail which is required for absorbing and diverting upwardly directed forces due to regularly occurring horizontal forces. The horizontal forces prevent smooth ruing of the traveling mechanisms inside the rail. The upwardly directed forces cannot be absorbed and transmitted in the pendulum-like suspension, making the pendulum-like suspension unsuitable for laterally cantilevering booms of two-rail cranes.

SUMMARY OF THE INVENTION

The object of the present invention is to provide a traveling mechanism for lifting devices which is movable on rigidly suspended rails using the conventional hollow-section rails which open downwardly by effectively diverting horizontal forces and uniformly distributing the vertical forces to the running wheels.

It is a further object of the present invention to provide a traveling mechanism for lifting devices for use with rails supported by a rigid suspension so that a smooth running is achieved and severe wear and destruction of the rails is prevented.

In a first embodiment, the present invention includes running wheel axles fixedly connected to a running wheel carrier. The running wheel carrier and connection element are connected via a universal type joint. At least one support roller is arranged in a stationary manner at the connection element in the interior of the rail. This support roller is freely rotatable about a vertical axis and rolls along at least one side surface of the interior of the rail.

A traveling mechanism constructed in this manner makes it possible for horizontal forces to be effectively passed on to the side surfaces of the hollow-section rails to prevent destruction or severe wear in rigid suspensions and to avoid severe twisting or deformation of the traveling mechanism and/or of the rails. Jamming of the traveling mechanism is also extensively prevented. A smooth running of the traveling mechanism is achieved also when a boom which is swivelable about a vertical axis and which generates alternating vertical forces is connected to the traveling mechanism.

A smooth running of the traveling mechanism is achieved in that the running wheels are arranged in two pairs of parallel running wheels, one pair behind the other along the traveling direction.

For automatically centering the traveling mechanism, the running surfaces of the rails are sloped toward one another and the ruing surfaces of each pair of the running wheels are cambered.

It has proven advantageous to provide at least two support rollers, each of which rolls on a side surface of the rails.

The smooth running of the traveling mechanism is achieved in particular in that a joint is formed of a ball head rigidly connected with the connection element and a correspondingly constructed ball socket arranged at the running wheel carrier.

To transmit the horizontal forces to the side walls, it is advantageous to rotatably support the support rollers in the upper region of the connection element, that is, near the rail fastening.

Functionally, the support rollers are best arranged between the pair of running wheels as viewed in the traveling direction.

Alternatively, the support rollers can also be advantageously arranged in front of and behind the running wheels as viewed in the traveling direction.

The connection element projecting out of the bottom of the rail includes one or two running rollers which rotate in a vertical plane and which can be adjusted from below relative to a horizontal outer running surface formed at the rail. In this manner, vertical forces are introduced directly into the rail. A simple adjustment or readjustment is made possible in that the runner roller can be guided into the rail by the upwardly directed vertical forces and adjusted from below in the direction of the rail via an eccentric bearing while leaving play between the running roller and rail to compensate for rail tolerances.

Very good guidance of the traveling mechanism is achieved in that running rollers are arranged on both sides of the connection element and the rail has horizontal outer running surfaces for the running rollers on both sides of the rail.

In a second embodiment of the present invention, the running wheel carrier and the connection element are rigidly connected with one another. The part of the connection element projecting down out of the rail connects with the load by a ball joint having a ball head and a ball socket. In a rigid suspension of the rails, the use of the ball joint leads to a reduction of the horizontal forces and jamming occurring during operation.

The present invention suggests supporting a trolley of a suspension crane, especially a crane with a laterally cantilevering boom. The trolley is movable on a rail or a plurality of rails arranged parallel to one another in the longitudinal direction of the rail by at least two traveling mechanisms, wherein the connection elements of the traveling mechanisms of the trolley which are arranged at the rail or rails are rigidly connected with one another by cross-pieces.

A trolley of this kind can be provided especially with a boom that is swivelable about a vertical axis without jamming which normally occurs with conventional suspension cranes with larger loads. The horizontal forces in a suspension crane constructed in this way are transmitted evenly and effectively into the rails. Deviations from the rail parameters lying within a given range of tolerances are compensated for by a suspension crane of this type so as to be free of jamming.

When two rails are arranged parallel to one another, two pairs of traveling mechanisms which are located at the same height considered in the traveling direction are provided. The imaginary connecting lines between the traveling mechanism pair advisably enclose an angle of 90° with the longitudinal direction of the rail.

A very stable running of the trolley is achieved with a three-point support in which two rails are arranged parallel to one another and a pair of traveling mechanisms is supported at one rail and an individual traveling mechanism is supported at the other rail.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the drawings, wherein like reference numerals denote similar elements throughout the several views.

DETAILED DESCRIPTION OF THE PRESENTLY PREFERRED EMBODIMENTS

Figure 1:
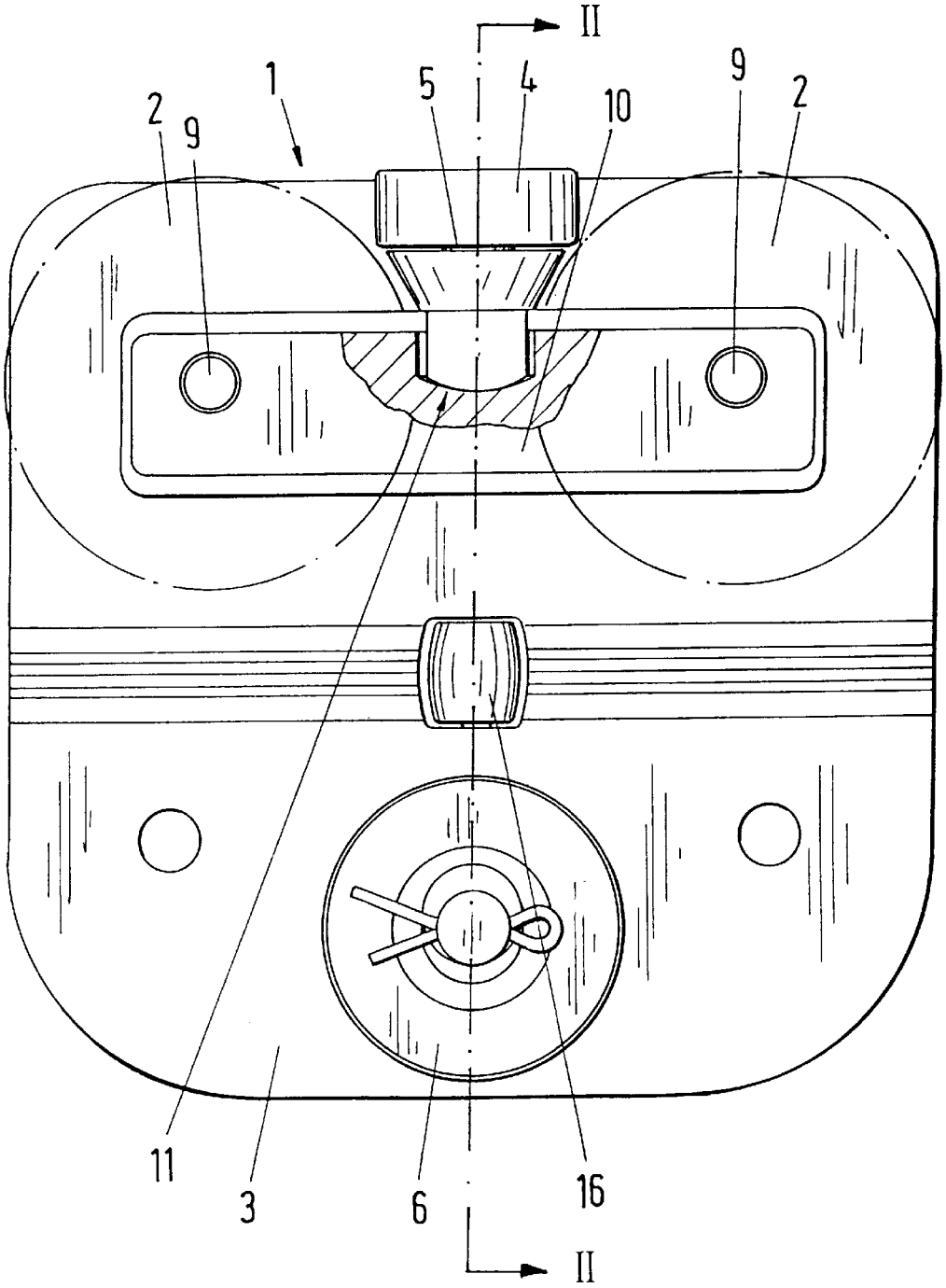
FIG. 1 is a side view of a traveling mechanism of the present invention.

Referring to FIG. 1 a traveling mechanism 1 for a lifting device which is movable on a rail includes a connection element 3 on which two pairs of cambered running wheels 2 are arranged one behind the other along the traveling direction of the traveling mechanism. Each pair includes two of the running wheels 2 parallel to one another on opposing sides of the connection element 3. Of course, it is also possible to arrange the running wheels 2 so that they are offset relative to one another on both sides of the connection element 3. Support rollers 4 are rotatably mounted on the upper region of connection element 3 between the running wheels 2 along the traveling direction on both sides of the connection element 3. Vertical rotational axes 5 of the support rollers 4 are supported at the connection element 3. In the preferred embodiment, exactly one support roller 4 is mounted on each side of the connection element 3. Of course, the support rollers 4 can also be mounted in front of and/or behind the running wheels 2, wherein a pairwise arrangement transverse to the traveling direction has proven especially suitable. However, an individual large support roller 4 is also conceivable. A running roller 6 which rotates in a vertical plane is mounted on both sides of a lower region of the connection element 3.

Figure 2:
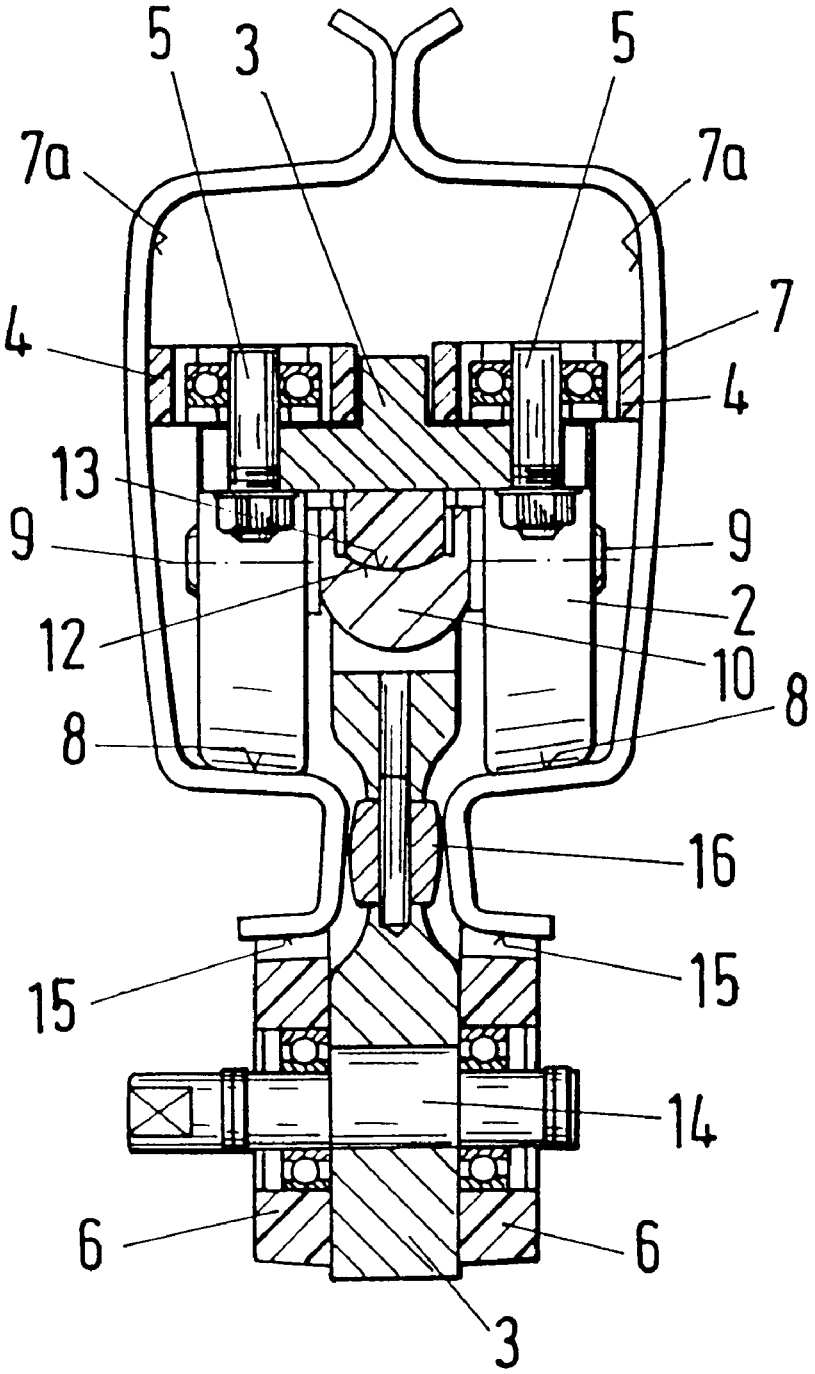
FIG. 2 is a sectional view of the traveling mechanism of FIG. 1 through line 11—11 in a rail in which the travelling mechanism is supported.

FIG. 2 shows a cross section of the traveling mechanism 1 which is mounted in the interior of a hollow-section rail 7. The rail 7 has a downward facing opening. The rail 7 has a cold-rolled, specially shaped cross section so that a low inherent weight and very good strength and stiffness values are achieved. The running wheels 2 roll on substantially horizontal inner running surfaces 8 which are sloped toward one another and extend in the longitudinal direction of the rails. Each one of the two support rollers 4 rolls in the interior of the rail 7 on one side surface 7*a*. The arrangement is constructed such that there is play in the middle position, that is, in the absence of horizontal forces. In this way, when horizontal forces occur which are to be diverted, only one of the support rollers 4 contacts a corresponding side wall 7*a* of the rail 7 so that these horizontal forces are introduced into the rail 7.

Referring now to FIGS. 1 and 2, to introduce horizontal forces into the side walls 7*a* without jamming the traveling mechanism 1 in the rail 7, two axles 9 of the running wheels 2 are connected with one another via a common running wheel carrier 10. The connection of the running wheel carrier 10 with the connection element 3 is effected via a universal joint 11. The construction of the universal joint is clearly illustrated by the partial sectional view in FIG. 1. The universal joint 11 includes a ball socket 12. The connection element 3 is supported in the ball socket 12 via a complementary ball-shaped surface 13 formed at the connection element 3. The connection element 3 and running wheel carrier 10 are swivelable relative to one another about the universal joint 11 within a defined angular area. In this way, jamming of the running mechanism is effectively prevented during traveling, so that a smooth running of the traveling mechanism 1 is achieved in spite of the horizontal forces to be diverted. This is further advantageous in that the load remains uniformly distributed to the running rollers 2 when the rail 7 is twisted.

FIG. 2 further shows that the connection element 3 projects downward out of the rail 7 for connecting a load to be supported and moved. The running rollers 6 are adjustable in the direction of the rail from below by positioning an eccentric axle 14 to ensure a connection between the traveling mechanism 1 and rail 7 which is free of play. The adjustment of the running rollers 6 is effected as follows: The traveling mechanism 1 is introduced into the rail 7 leaving a play of 1 mm, for example between the upper part of the running rollers 6 and the rail 7; a readjustment is possible at any time during operation. As is shown in FIG. 2, the adjustment of the running rollers 6 is effected from below at a horizontal outer running surface 15 of the rail 1. For this purpose, the running rollers 6 are rotatably supported by the eccentric axle 14. The running rollers 6 are supported at the connection element 3 by the eccentric axle 14.

With very large horizontal forces such as occur in exceptional cases, a sliding roll 16 prevents damage to the traveling mechanism 1 and/or to the rail 7.

Figure 3:
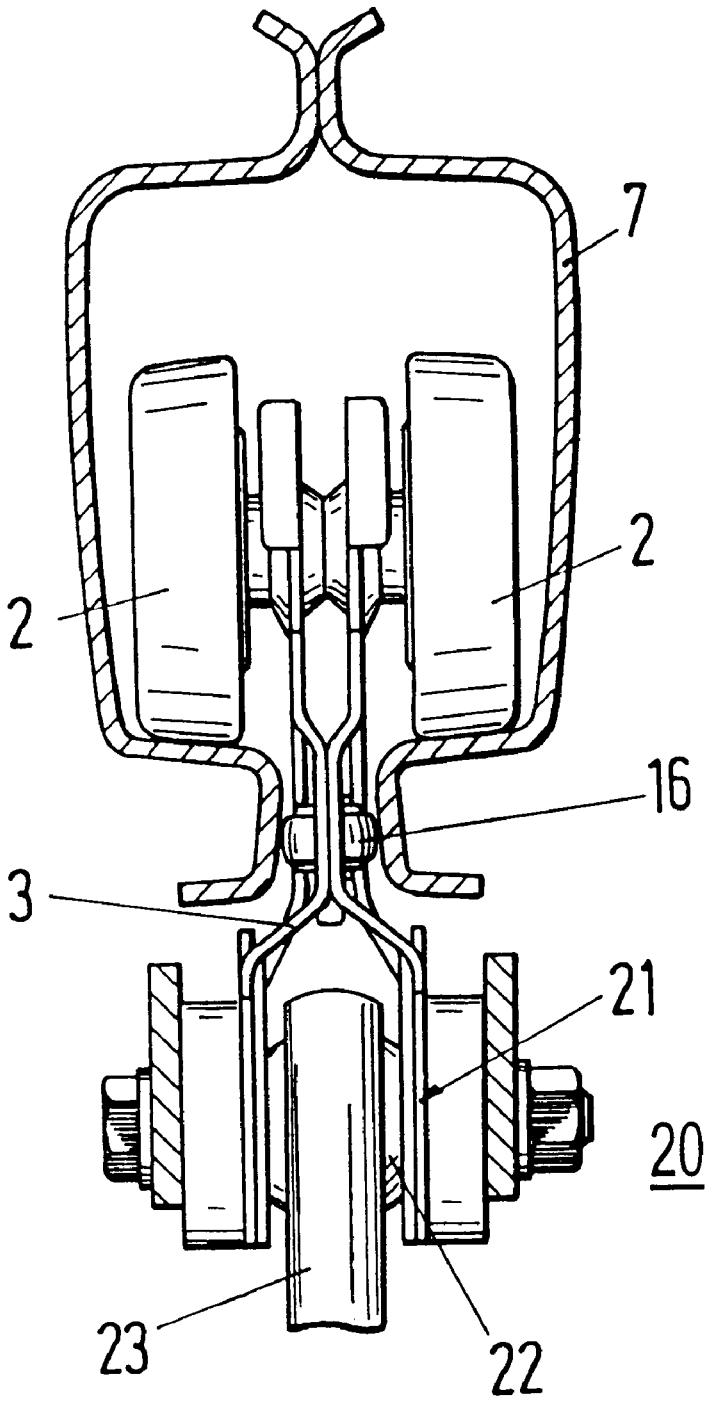
FIG. 3 is a sectional view of another embodiment of the traveling mechanism of FIG. 1 through line II—II in a rail in which the travelling mechanism is supported.

Another embodiment of the traveling mechanism 1, shown in FIG. 3, includes the running wheel carrier 10 rigidly connected to the connection element 3. In other words, the articulated connection of these two structural component parts is absent in this embodiment of the traveling mechanism 1. In exchange, the portion of the connection element 3 projecting downward out of the rail 7 has a ball joint 20 which is formed of a ball socket 21 formed at the connection element 3 and of a ball head 22 inserted into the ball socket 21, wherein the ball head 22 is connectable to a load for supporting the load via a carrying element 23 (which can be, for example, a load hook).

Figure 4:
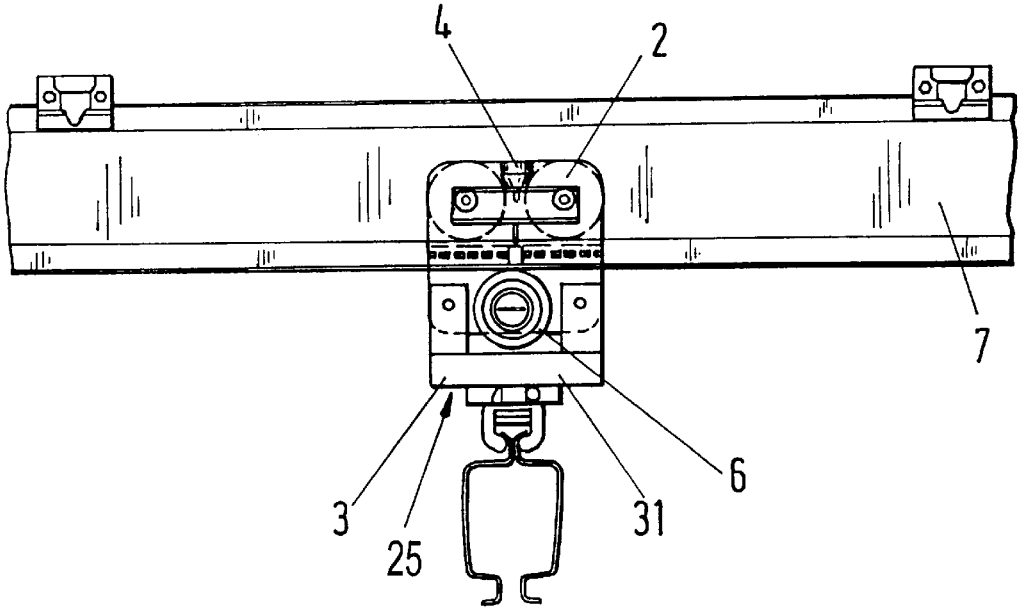
FIG. 4 is a side view of a trolley of a suspension crane which uses the travelling mechanism of FIG. 1 for support.
Figure 5:
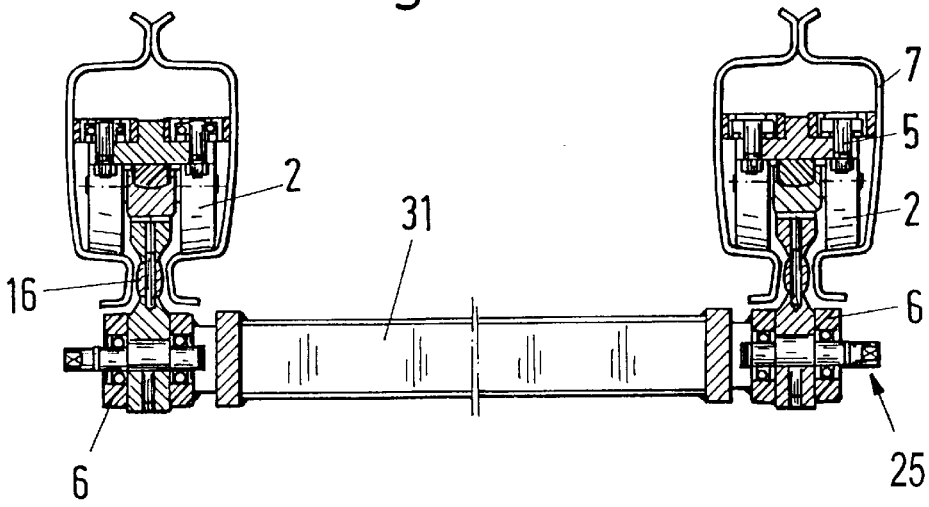
FIG. 5 is a sectional view along line V—V of the trolley of FIG. 4 showing two traveling mechanisms of a trolley which are rigidly connected with one another.
Figure 6:
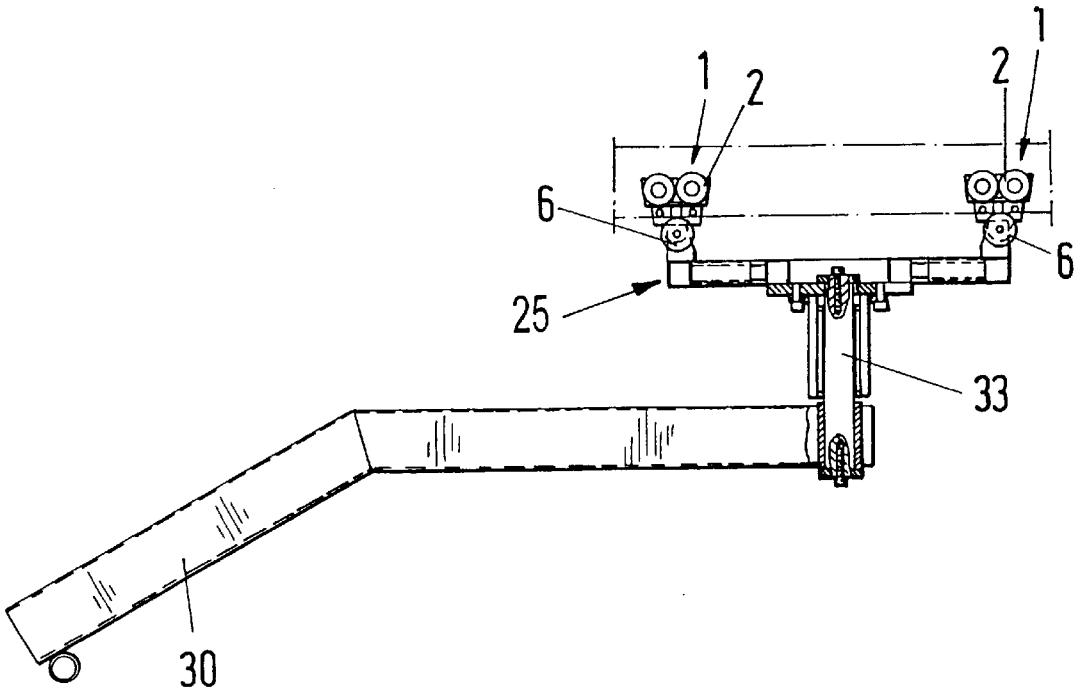
FIG. 6 shows a trolley of a suspension crane with a boom which is swivelable about a vertical axis.
Figure 7:
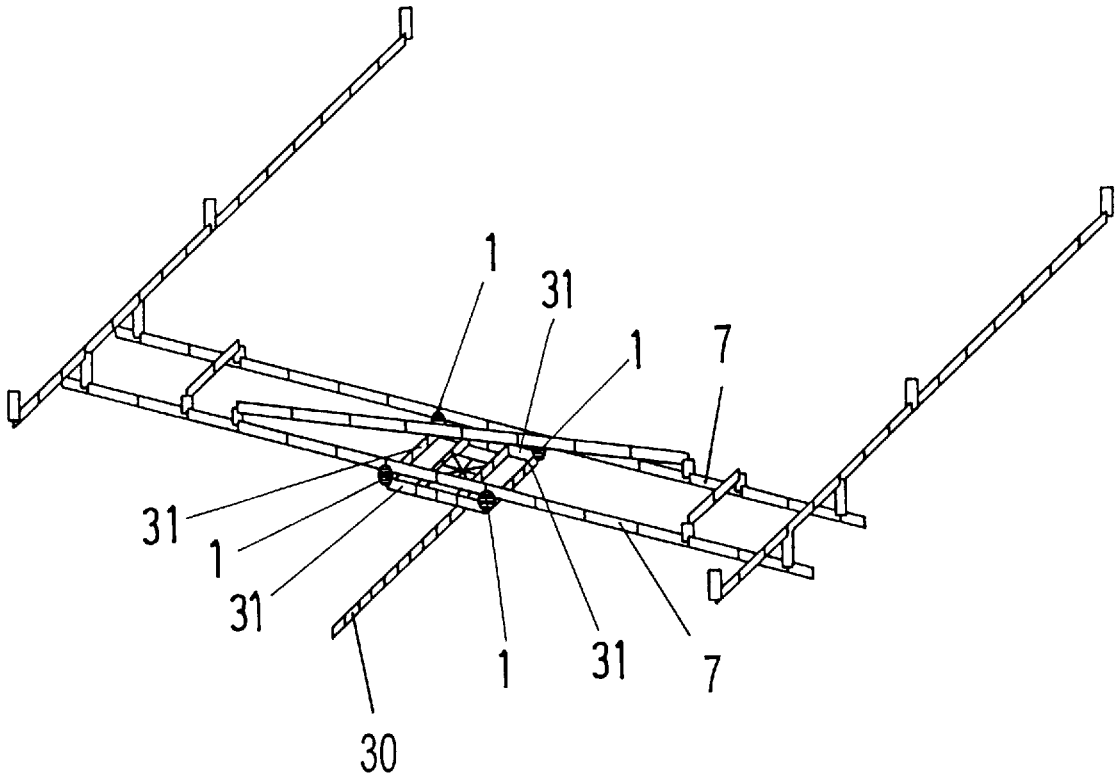
FIG. 7 is a schematic view of a suspension crane with a trolley mounted on a rigid suspension.

FIGS. 4 and 5 show a trolley 25 of a suspension crane on which a lift (not shown), for example, is movable. With respect to the trolley 25, it is essential that the connection elements 3 of the traveling mechanisms 1 arranged at different rails are rigidly connected with one another by a crosspiece 31 as shown in cross section in FIG. 5. The trolley 25 of this type already has very good running characteristics and load carrying characteristics. Even so, an appreciable improvement is achieved when two pairs of traveling mechanisms 1 are combined (See FIG. 6). For this purpose, the connection elements 3 of the traveling mechanisms 1 which are arranged at different rails 7 and which are at the same height considered in the traveling direction are connected with one another by crosspieces 31. The longitudinal direction of the crosspiece 31 and the longitudinal direction of the rail 7 are perpendicular. Referring to FIGS. 6 and 7, a combined traveling mechanism of this type formed of four traveling mechanisms 1 connected with one another via crosspieces 31 so as to be rigid against bending can be used very suitably with a boom 30, since all horizontal forces are effectively introduced into the rails 7. It is possible to swivelably connect the boom 30 to the trolley 25 about a vertical swivel axis 33. It has been shown that when a load is swiveled in this arrangement there is virtually no vertical lowering of the load, so that a swiveling of the load can be effected by an operator in every desired position with little expenditure of force. FIG. 7 shows a schematic view of such a suspension crane with a trolley.

Alternatively, a stable running of the trolley 25 can also be achieved by a three-point support of the trolley 25 in that with two rails 7 arranged parallel to one another a pair of traveling mechanisms 1 is arranged at one rail 7 and an individual traveling mechanism 1 is arranged at the other rail 7.

The invention is not limited by the embodiments described above which are presented as examples only but can be modified in various ways within the scope of protection defined by the appended patent claims.

We claim:

1. A traveling mechanism for a ling device movable on a downward-opening hollow rail of an overhead track, said downward-opening hollow rails having substantially horizontal running surfaces extending along a longitudinal direction of said rail and sloped toward one another, inner side surfaces extending upward from sides of said running surfaces, and a horizontal outer running surface on a bottom of said substantially horizontal running surface of said rail, said traveling mechanism comprising:

a connection element for attaching a load;

a running wheel carrier swivelably connected to said connection element via a universal joint;

at least two running wheel axles rigidly connected to said running wheel carrier;

at least two running wheels rotatably connected to said at least two running wheel axles on both sides of said running wheel carrier for supporting said connection element on said horizontal running surfaces;

a lower portion of said connection element projecting downwardly out of said rail when said traveling mechanism is mounted in said rail;

at least one running roller rotatably connected to said lower portion of said connection element for rolling against said horizontal outer running surface of said rail; and at least one support roller being rotatably mounted about a vertical axis on said connection element for rotating against at least one of said inner side surfaces of said rail.

2. The traveling mechanism of claim 1, wherein said at least two running wheels comprise two pairs of running wheels, one of said two pairs positioned behind the other in a traveling direction of said traveling mechanism, and each of said two pairs comprises two parallel running wheels positioned on opposing sides of said traveling mechanism.

3. The traveling mechanism of claim 1, wherein said running wheels comprise running surfaces that are cambered.

4. The traveling mechanism of claim 1, wherein said at least one support roller comprises two support rollers, each of which can roll on one of said inner side surfaces.

5. The traveling mechanism of claim 1, wherein said universal joint comprises a ball head rigidly connected to said connection element and a correspondingly constructed ball socket arranged at said running wheel carrier for receiving said ball head.

6. The traveling mechanism of claim 1, wherein said at least one support roller is rotatably supported in an upper region of said connection element.

7. The traveling mechanism of claim 1, wherein said at least one support roller is mounted between said running wheels along a traveling direction of said traveling mechanism.

8. The traveling mechanism of claim 1, wherein said at least one support roller is positioned in front of, and at least another support roller is positioned behind, said running wheels along a traveling direction of said traveling mechanism.

9. The traveling mechanism of claim 1, wherein said at least one running roller is adjustable from below in the direction of said rail via an eccentric bearing.

10. The traveling mechanism of claim 1, wherein said at least one running roller is positioned on both sides of said connection element and said at least one running roller rotatably engages said horizontal outer running surface on both sides of said rail.

* * * * *